United States Patent [19]

Gezari et al.

[11] Patent Number: 4,907,797

[45] Date of Patent: Mar. 13, 1990

[54] MUSCLE EXERCISE AND/OR REHABILITATION APPARATUS USING LINEAR MOTION

[75] Inventors: Walter Gezari, Rocky Point, N.Y.; Daniel Y. Gezari, Chevy Chase, Md.

[73] Assignee: Biodex Corporation, Shirley, N.Y.

[21] Appl. No.: 198,568

[22] Filed: May 25, 1988

[51] Int. Cl.[4] ..... A63B 21/24

[52] U.S. Cl. ..... 272/129; 272/118; 272/134; 272/DIG. 6

[58] Field of Search ..... 272/129, DIG. 6, 134, 272/111, 146, 117, 118; 128/25 R

[56] References Cited

U.S. PATENT DOCUMENTS

| | | | |
|---|---|---|---|
| Re. 28,066 | 7/1974 | Marcyan | 272/118 |
| 857,447 | 6/1907 | Cooper | 272/129 X |
| 3,389,910 | 6/1968 | Kansler, Jr. | 272/146 |
| 3,690,655 | 9/1972 | Chapman | 272/117 X |
| 3,848,467 | 11/1974 | Flavell | 272/DIG. 6 X |
| 4,199,137 | 4/1980 | Giguére | 272/146 X |
| 4,208,049 | 6/1980 | Wilson | 272/140 |
| 4,620,703 | 11/1986 | Greenhut | 272/129 |
| 4,673,180 | 6/1987 | Rice | 272/146 |
| 4,700,944 | 10/1987 | Sterba et al. | 272/117 |
| 4,799,671 | 1/1989 | Hoggan et al. | 272/118 |
| 4,822,037 | 4/1989 | Makansi et al. | 272/129 |

FOREIGN PATENT DOCUMENTS

| | | | |
|---|---|---|---|
| 3613618 | 5/1987 | Fed. Rep. of Germany | 272/129 |
| 2158362 | 11/1985 | United Kingdom | 272/134 |
| 8202667 | 8/1982 | World Int. Prop. O. | 272/118 |

*Primary Examiner*—Richard J. Apley
*Assistant Examiner*—Joe H. Cheng
*Attorney, Agent, or Firm*—Cobrin, Feingertz & Gittes

[57] ABSTRACT

A muscle exercise and/or rehabilitation apparatus includes a fixture against which a force can be applied; a sensor which senses the force applied to the fixture and produces a load signal corresponding thereto; a speed detector which produces a velocity signal corresponding to the speed of the fixture; a servo motor which produces a rotational output of an output shaft thereof; a closed loop servo circuit which controls the motor in response to the load signal and the velocity signal to control rotation of the output shaft of the servo motor; and a conversion device connected between the fixture and the output shaft of the servo motor for translating the rotational output of the output shaft to linear motion of the fixture, the conversion device including a frame formed by a base, two spaced vertical support bars extending upwardly from the base, and an upper cap securing upper ends of the vertical support bars together, two vertical guide rods supported by the frame, a slide movable along the guide rods in such linear motion, an operational pulley rotatably connected with the output shaft of the servo motor, and a rope secured to the slide and wrapped about the pulley for controlling movement of the slide in the linear motion in response to the output shaft of the servo motor.

24 Claims, 6 Drawing Sheets

MUSCLE EXERCISE AND/OR REHABILITATION APPARATUS USING LINEAR MOTION

BACKGROUND OF THE INVENTION

This invention relates generally to muscle exercise and rehabilitation apparatus, and more particularly, is directed to such apparatus in which controlled rotational motion is converted to controlled linear motion to evaluate the entire body for lifting performance, particularly with respect to work fitness and disability.

In many cases, it is desirable to simulate the demands of the workplace for screening or training purposes. Specifically, it is desirable to measure physical capacity by measuring strength in the context of specific job requirements. This is particularly important in view of the fact that the National Institute for Occupational Safety and Health (NIOSH) has indicated that substantial strength is required in approximately one-third of all jobs in the United States.

In addition, overexertion on and off the job is a major cause of lower back pain. This entails a significant amount of lost time. Thus, the incidence of lower back pain with different musculoskeletal disorders and injuries is high in the United States. Accordingly, it is also desirable to impose demands on the musculoskeletal system of the spine in order to stimulate metabolic, ligamentous, facial, cardiovascular, and neuromuscular adaptations resulting in performance enhancement, and to also engage motor learning mechanisms for performance enhancement.

The above simulation and performance enhancements are preferably performed under loaded or velocity controlled conditions. In particular, it is desirable to reproduce lifting and lowering of weights when task parameters are controlled and measured by a force sensing and generating device interfaced with a computer system. Such lift simulation would primarily involve the extensor musculature and the axial/proximal musculoskeletal control system of the body. In such case, muscle group strength, power and endurance necessary for occupational task performance can be quantified.

Various exercising machines, such as those designated by "Universal", "Nautilus", "Cybex" and "Kin/-Com", are well known in the art.

One of the first of these machines was the "Universal" exercising machine which uses a pulley-weight system, whereby the weights added to the pulley system can be varied by the user. With such apparatus, however, there are no controls over the manner, that is, the speed of movement and the torque applied by the user, in overcoming the weight load. It is only necessary that the user apply a force that is greater than the weight load through the pulley system. As such, the "Universal" apparatus is similar to a free weight system. An apparatus of the "Universal"-type is described in U.S. Pat. No. 4,691,916 to Voris. See also U.S. Pat. No. 4,339,125 to Uyeda et al.

U.S. Pat. No. 477,613 to Sundh discloses a similar weight training machine which uses a pulley system. However, there is no translation of a controlled rotational movement to a controlled linear movement for the purpose of clinical evaluations.

U.S. Pat. No. 4,620,703 to Greenhut merely describes a drum and pulley exercise machine that provides linear motion. However, there is no controlled rotational motion that is converted to linear motion for the purpose of clinical evaluations. See also U.S. Pat. No. 4,529,196 to Logan et al. and U.S. Pat. No. 4,728,102 to Pauls.

With all of such apparatus, however, there is no controlled movement of the velocity or torque of the linear arm, whereby clinical testing can be performed to simulate imposed work demands and/or for performance enhancement.

The "Nautilus" apparatus was developed to overcome some of the deficiencies of the "Universal" machine by providing a fixed path of movement of the respective arms thereof so that the latter follow respective paths designed for better muscle isolation during exercise. The "Nautilus" apparatus, rather than using a pulley-weight system, uses a novel cam arrangement. However, as with the "Universal" machine, the "Nautilus" apparatus does not control the speed of movement or resistive torque applied to the arm.

The "Cybex" apparatus, as exemplified in U.S. Pat. No. 3,465,592, recognized that the muscle is not equally powerful throughout its entire range of motion. The "Cybex" apparatus provides a motor connected through a gearing system to regulate the exercise arm of the machine so that it travels with a constant velocity, thereby taking into account the different strengths of the muscle during different angular extensions thereof.

Although the "Cybex" apparatus provides distinct advantages over the aforementioned "Universal" and "Nautilus" apparatus, the "Cybex" apparatus fails to provide necessary functions for truly accurate and corrective exercise and rehabilitation. In this regard, the "Cybex" apparatus uses a motor with two clutches. The arm of the apparatus is movable freely until the planetary speed of the gearing therein is reached, whereupon an impact resistive force is met by the user. This impact resistive force, of course, is undesirable, particularly from a rehabilitation standpoint. In addition, the "Cybex" apparatus does not provide for any translation of a controlled rotational motion to a linear motion, whereby accurate simulations can be provided.

U.S. Pat. No. 4,235,437 discloses a robotic exercise machine which uses a computer to regulate the motion of an exercise arm in response to software programmed into the machine and in response to the force applied to the arm by the user as detected by a strain gauge at the end of the arm. By means of hydraulic cylinders and solenoid controlled valves, movement of the arm can be accurately controlled. However, the equipment provided in U.S. Pat. No. 4,235,437 is relatively complicated and requires expensive computer equipment and a complex linkage system. Further, because the equipment is computer controlled, the user must spend some time programming the computer with the desired settings before exercising. This, of course, is time consuming and detracts from the exercise.

It is to be appreciated that, with muscle exercise and rehabilitation apparatus, it is necessary that movement of the arm be smooth in all modes of operation, particularly when simulating work conditions or imposing demands that result in performance enhancement. A problem with computer controlled apparatus is that the computer must make various samplings and computations, and thereafter makes corrections that are necessary. Although computer time is generally considered fast, the amount of time necessary for the computer to perform such operations and then control the mechanical and hydraulic devices of the apparatus may not result in smooth movement of the exercise arm, particularly at small loads.

There is also known a muscle exercise and rehabilitation apparatus sold by Chattecx Corporation of Chattanooga, Tenn. under the name "Kin/Com" which provides a computer controlled hydraulic system that monitors and measures velocities, angles and forces during muscular contractions. A load cell is provided to measure the force at the point of application, with an accuracy of 4 ounces. However, this apparatus, being computer controlled, suffers from the same problems discussed above with respect to U.S. Pat. No. 4,235,437. Further, there is no conversion of controlled rotational motion to a linear motion for the purposes described above.

U.S. Pat. Nos. 3,848,467 and 3,869,121 each disclose an exercise machine in which a user applies a force to an arm which is coupled to a drive shaft, the latter being driven by a servo motor through a speed reducer. A brake is connected to the servo motor through the speed reducer, although in the embodiment of FIG. 3, a permanent magnet servo motor is used as both the powering means and the brake. A speed and direction sensor is connected with the drive shaft, the servo motor or the speed reducer, and supplies a signal to a comparator, corresponding the direction and speed of the arm. Another input of the comparator is supplied with a signal from a speed and direction programmer, corresponding to a desired speed and direction of movement of the arm. The comparator controls the powering means and the brake in response to these signals to regulate the system speed, responsive to varying exercises force applied to the arm during both concentric and eccentric muscular contractions.

With these latter Patents, however, there is a drum and pulley arrangement, which is not conducive to simulating imposed demands of the workplace for screening or training, and is not conducive to performance enhancement in accordance with the demands as set forth above. Further, there is no disclosure of any conversion of a controlled rotational motion to a linear motion for such purposes.

In order to overcome problems with the latter patents, there is disclosed in U.S. Pat. No. 4,628,910, having a common assignee herewith and the entire disclosure of which is incorporated herein by reference, a muscle exercise and rehabilitation apparatus in which the servo motor is used to move the arm at all times.

Specifically, as disclosed therein, in the concentric isokinetic mode of operation, the arm is controlled to move with a regulated velocity in the direction of force applied by the user, for both flexion (bending) and extension (unbending) of the limb. For example, in a knee extension/flexion operation, where a cuff at the end of the arm is brought from a vertical to a horizontal position of the user, the servo motor which controls movement of the arm, is driven at a velocity dependent upon the force applied by the user, and in the same direction as the applied force, until a predetermined clamp velocity is reached. Once the predetermined clamp or set velocity is reached, the servo motor drives the arm at a predetermined constant velocity, whereby the arm moves with a constant velocity in the direction of force applied by the user. Thus, if the force applied by the user is too great, that is, will normally drive the arm at a velocity greater than the clamp velocity, the servo motor only drives and/or allows the arm to move at the predetermined clamp velocity. If the user stops applying the force, the arm will stop moving.

During the return movement, where the cuff is brought from the horizontal position to the lower vertical position, during flexion, the user must apply a force in the downward direction in order for the cuff to be moved downwardly. The servo motor moves the arm and the cuff, initially at a velocity dependent upon the downward force applied by the user. Once the velocity reaches a predetermined clamp velocity, the servo motor drives the arm at the predetermined velocity, whereby the arm moves with a constant velocity in the direction of force applied by the user. As with extension, if the user stops applying the force, the arm will cease moving with a constant velocity and come to a full stop.

Thus, with such apparatus, for flexion and extension, the servo motor drives the arm. The user does not move the arm but merely provides a measured force by which the servo motor is controlled.

In the eccentric isokinetic mode of operation, the arm is controlled to move with a regulated velocity in the direction opposite to the direction of force applied by the user, for both flexion and extension of the limb. In one embodiment, the range of speeds is much smaller than that in the concentric isokinetic mode in order to prevent harm to the user. However, again, for both flexion and extension, the servo motor drives the arm.

In the passive or oscillation mode, the arm is caused to oscillate by the servo motor at a constant speed, regardless of the force applied by the user. If there is a force applied by the user, regardless of the direction of such force (either concentric or eccentric), which would cause the arm to change its speed of oscillation, the servo motor controls the arm to maintain the constant speed.

In all of the above modes, it is the servo motor which moves the arm in response to the sensed velocity and/or predetermined force applied to the arm. The user does not move the arm. Because the servo motor is used to move the arm at all times, movement of the arm can be linearly controlled in response to the force applied thereto for forces within the range of 0–400 foot-pounds.

With such apparatus, circuitry is provided for limiting the angular range of motion of the arm.

However, such apparatus is intended to only apply a rotational movement to the arm. Therefore, it is difficult to simulate imposed demands of the workplace or provide performance enhancement by demands imposed on the musculoskeletal system or by engaging motor learning mechanisms.

U.S. Pat. No. 4,691,694 is a Continuation-In-Part of U.S. Pat. No. 4,628,910, and the entire disclosure thereof is incorporated herein by reference. U.S. Pat. No. 4,691,694 discloses a more advanced version of the apparatus of U.S. Pat. No. 4,628,910, but it also suffers from the same deficiencies with regard to the purposes set forth above.

OBJECTS AND SUMMARY OF THE INVENTION

Accordingly, it is an object of the present invention to provide a muscle exercise and/or rehabilitation apparatus that overcomes the aforementioned problems with the prior art.

It is another object of the present invention to provide a muscle exercise and/or rehabilitation apparatus that can be used for testing in clinical operations.

It is still another object of the present invention to provide a muscle exercise and/or rehabilitation apparatus that can be used for evaluation or whole-body lifting performance;

It is yet another object of the present invention to provide a muscle exercise and/or rehabilitation apparatus that can be used for functional lift training and performance rehabilitation;

It is a further object of the present invention to provide a muscle exercise and/or rehabilitation apparatus that can be used to simulate imposed demands of the workplace for screening or training purposes;

It is a still further object of the present invention to provide a muscle exercise and/or rehabilitation apparatus that can be used to impose demands on the musculoskeletal system of the spine to stimulate metabolic, ligamentous, facial, cardiovascular and neuromuscular adaptations resulting in performance enhancement;

It is a yet further object of the present invention to provide a muscle exercise and/or rehabilitation apparatus that can be used to engage motor learning mechanisms for performance enhancement;

It is another object of the present invention to provide a muscle exercise and/or rehabilitation apparatus that accomplishes the above objects by conversion of a controlled rotational motion to a linear motion;

It is a still another object of the present invention to provide a muscle exercise and/or rehabilitation apparatus in which the user performs a linear motion that is controlled by the rotational motion of the output shaft of a servo motor.

In accordance with an aspect of the present invention, a muscle exercise and/or rehabilitation apparatus includes fixture means against which a force can be applied; sensing means for sensing the force applied to the fixture means and for producing a load signal corresponding thereto; speed detecting means for producing a velocity signal corresponding to the speed of the fixture means; servo motor means for producing a rotational output of an output shaft thereof; closed loop servo means for controlling the motor means in response to the load signal and the velocity signal to control rotation of the output shaft of the servo motor means; and conversion means connected between the fixture means and the output shaft of the servo motor means for translating the rotational output of the output shaft to linear motion of the fixture means.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
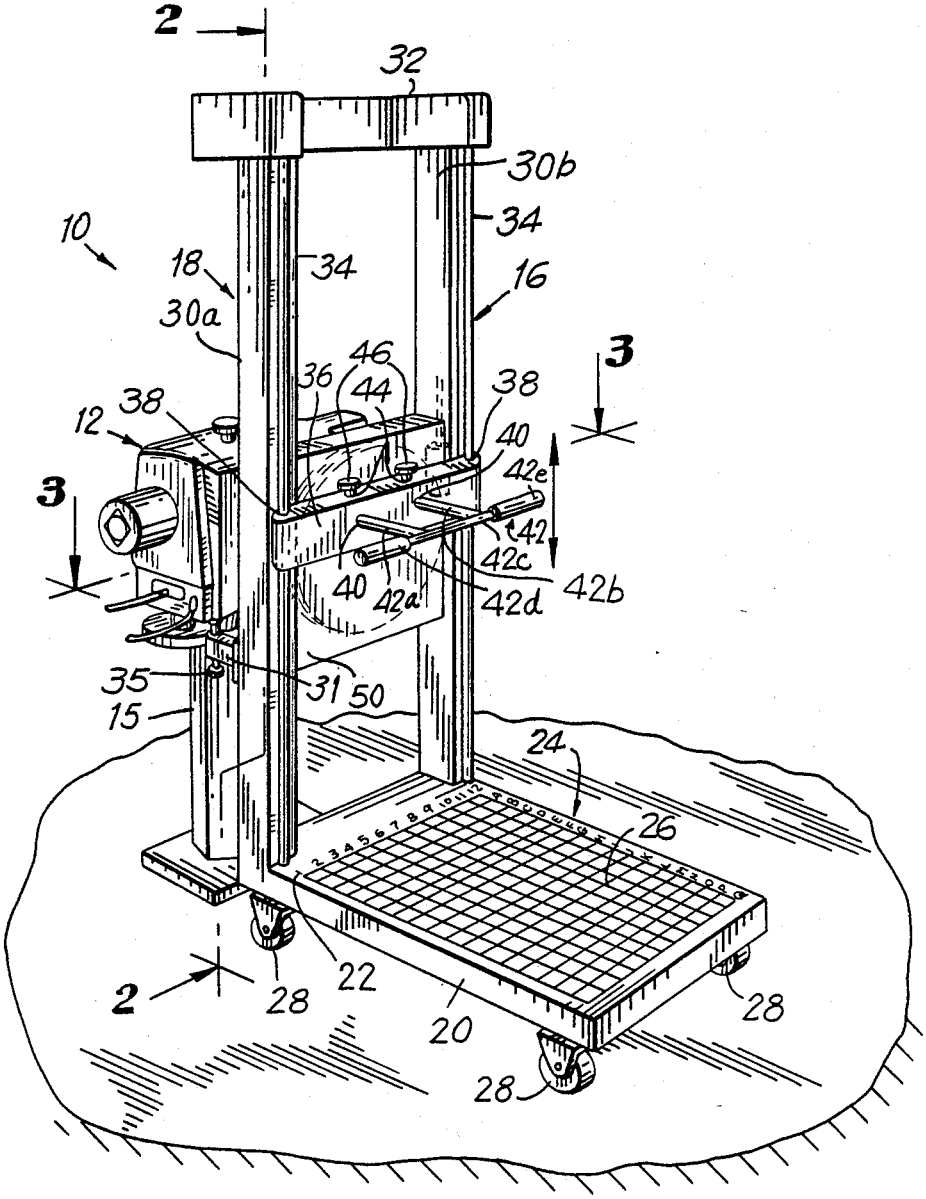
FIG. 1 is a perspective view of muscle exercise and/or rehabilitation apparatus according to one embodiment of the present invention.

Referring to the drawings in detail, and initially to FIG. 1 thereof, a muscle exercise and/or rehabilitation apparatus 10 according to the present invention includes a dynamometer 12 which is constructed identically to that described and shown in U.S. Pat. No. 4,691,694, the entire disclosure of which is incorporated herein by reference. As such, dynamometer 12 has an output shaft 14 which is controlled to move in an isokinetic, isotonic or isometric mode of operation. Dynamometer 12 is supported on a stand 15.

In accordance with the present invention, a device 16 is provided by which the controlled rotational motion of output shaft 14 is converted to a linear motion, in order to accurately simulate imposed demands of the workplace and provide performance enhancement, as described above.

Specifically, device 16 includes a frame 18 formed by a flat base 20 having numerical markings 22 and alphabetical markings 24 thereon along mutually orthogonal axes, and a gridwork 26, any position on such gridwork 26 defined by such numerical markings 22 and alphabetical markings 24. As such, the position of the user can be accurately defined for testing purposes. Base 20 is preferably supported on four casters 28 at the four corners thereof, to permit easy mobility of device 16, and so as to accurately align device 16 with dynamometer 12.

Figure 2:
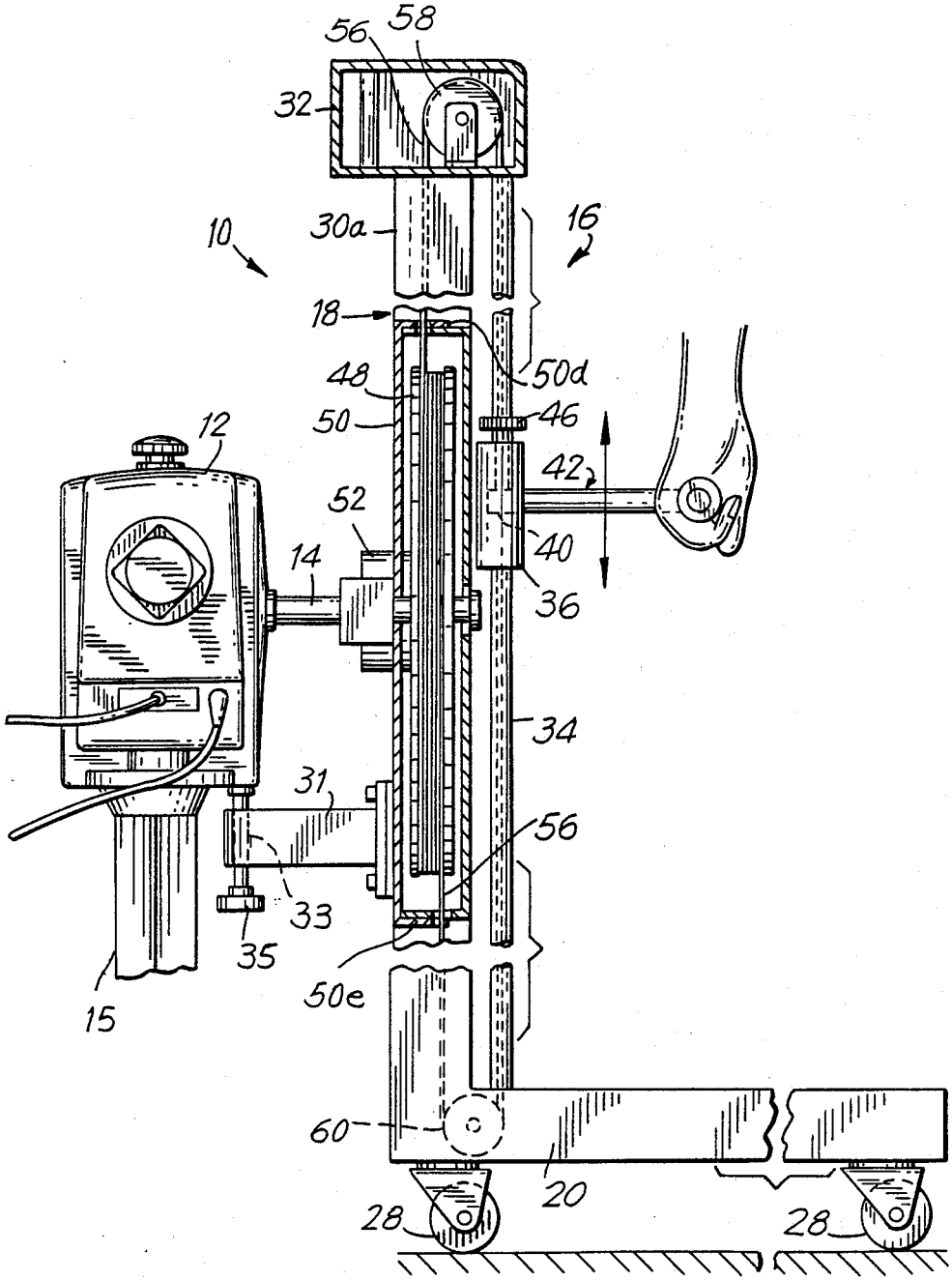
FIG. 2 is a cross-sectional view of the muscle exercise and/or rehabilitation apparatus of FIG. 1, taken along line 2—2 thereof.
Figure 3:
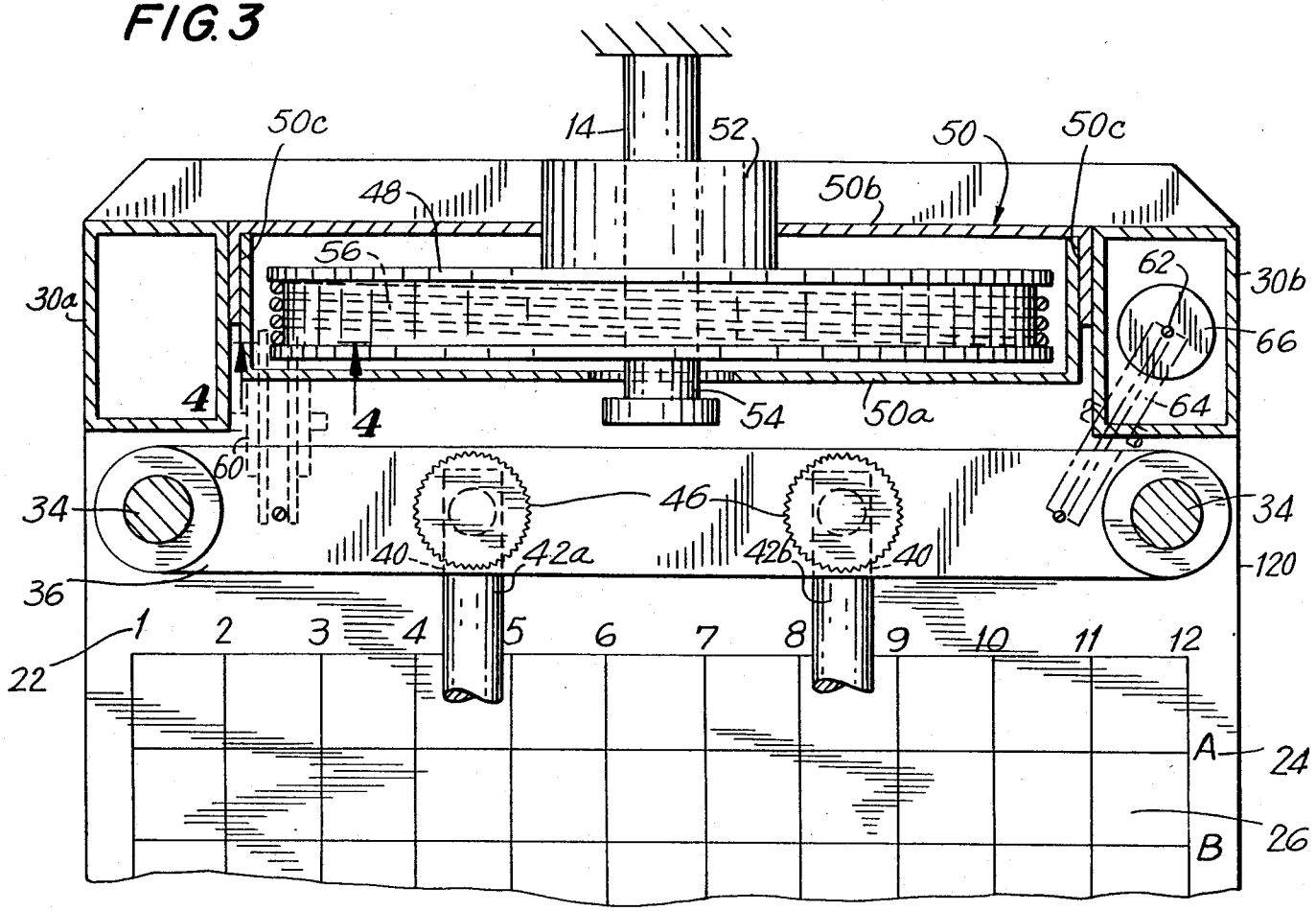
FIG. 3 is a cross-sectional view of the muscle exercise and/or rehabilitation apparatus of FIG. 1, taken along line 3—3 thereof.
Figure 4:
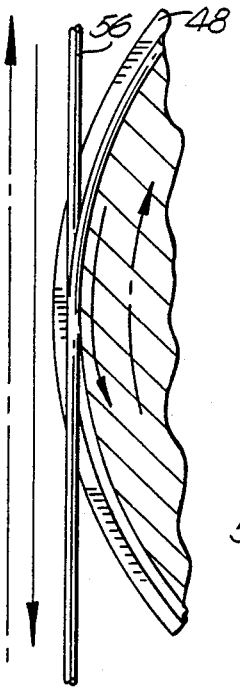
FIG. 4 is a cross-sectional view of the muscle exercise and/or rehabilitation apparatus of FIG. 3, taken along line 4—4 thereof.

Frame 18 includes two parallel, hollow, vertical support posts **30*a* and 30*b* at two corners on the same side of base 20. Preferably, vertical support posts 30*a* and 30*b* have a rectangular cross-section as shown in FIG. 3. A hollow upper cap 32 connects the upper ends of vertical support posts 30*a* and 30*b*. As best shown in FIG. 2, a connecting bar 31 is bolted to vertical support post 30*a* and extends rearwardly thereof, connecting bar 31 having a vertical bore 33 at the free end thereof for receiving a securing bolt 35 therethrough that is screw-threadedly received in the body of dynamometer 12 to secure dynamometer 12 to frame 18** in a fixed manner.

Further, two guide rods 34 are provided in front of vertical support posts **30*a* and 30*b* in parallel relation thereto, each guide rod 34 extending from base 20 to cap 32. A slide 36 extends between guide rods 34 and includes two parallel through bores 38 at opposite ends thereof, with guide rods 34 extending through bores 38, whereby slide 36 is slidably retained on and movable along guide rods 34**.

As shown, slide 36 includes two spaced apertures 40 in the front wall thereof for receiving a fixture 42 which is intended to be grasped by the user. Slide 36 also includes two screw-threaded apertures 44 in the upper wall thereof and which are in open communication with respective apertures 40. A securing bolt 46 is screw-threadedly received in each aperture 44, so as to engage the arms of fixture 42 inserted through apertures 40, and to thereby removably secure fixture 42 to slide 36.

Thus, in the embodiment of FIG. 1, fixture 42 includes two parallel, spaced rod-like arms 42*a* and 42*b*, each of which is inserted through a respective aperture 40 and removably held therein by securing bolts 46. Fixture 42 also includes a rod-like grasping arm 42*c* connected substantially perpendicular to the free ends of arms 42*a* and 42*b*. Grasping arm 42*c* has a length greater than the length between arms 42*a* and 42*b*, and rubber-like hand grips 42*d* and 42*e* are positioned over the free ends of grasping arm 42*c* for gripping by the user during operation of muscle exercise and/or rehabilitation apparatus 10.

As shown best in FIGS. 2 and 3, a large operational pulley 48 is rotatably connected to frame 18 at a position between vertical support posts 30*a* and 30*b*. Specifically, frame 18 includes a thin, substantially square or rectangular box-like housing 50 connected between vertical support posts 30*a* and 30*b*, housing 50 including a front wall 50*a*, a rear wall 50*b*, side walls 50*c*, a top wall 50*d* and a bottom wall 50*e*. Side walls 50*c* are connected to the inner walls of vertical support posts 30*a* and 30*b*. A bearing structure 52 is connected to rear wall 50*b* and has a rotatable shaft 54 extending forwardly therefrom through front wall 50*a*. Pulley 48 is mounted on shaft 54 so as to be freely rotatable in housing 50. In addition, output shaft 14 of dynamometer 12 is removably connected with rotatable shaft 54 through bearing structure 52. Accordingly, output shaft 14 controls rotation of pulley 48 through rotatable shaft 54 in accordance with the settings made on dynamometer 12, as described in detail in U.S. Pat. No. 4,691,694.

A non-extensible rope 56 has one end secured to pulley 48 and is then wound about pulley 48. From there, rope 56 extends upwardly, through top wall 50*d* of housing 50 and adjacent the inner wall of vertical support post 30*a* to an upper guide pulley 58 freely rotatably mounted in upper cap 32. After extending over guide pulley 58, rope 56 extends downwardly through and in connection with slide 36 to a lower guide pulley 60 mounted in a recess (not shown) in base 20. After extending around guide pulley 60, rope 56 extends upwardly and is once again connected to pulley 48. Of course, it will be appreciated that rope 56 can be an endless rope that extends along the same course. In such case, there would be no need to connect it to pulley 48, but rather, it would only be necessary to wrap it around pulley 48.

By means of this arrangement, since rope 56 is connected with slide 36, rotation of pulley 48 results in movement of rope 56 and thereby movement of slide 36 along guide rods 34. Since rotation of pulley 48 is controlled by dynamometer 12 through output shaft 14 thereof, accurate linear control of slide 36 along guide rods 34 can be achieved in correspondence with the functions of dynamometer 12 in an isokinetic, isometric and isotonic mode of operation, as detailed in U.S. Pat. Nos. 4,628,910 and 4,691,694 to the same assignee herewith, and the entire disclosures of which have been incorporated herein by reference.

Figure 5:
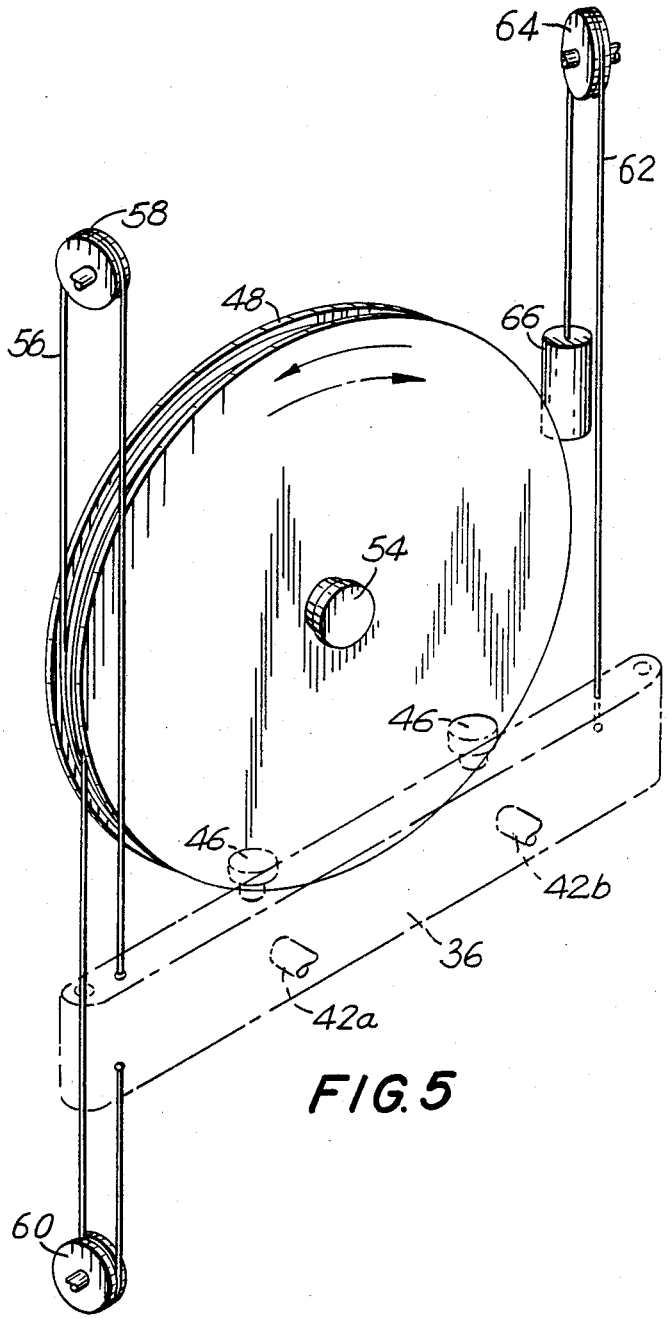
FIG. 5 is a perspective view of a portion of the muscle exercise and/or rehabilitation apparatus of FIG. 1, showing the counterweight system thereof.

Since slide 36 and fixture 42 contains some weight which dynamometer 12 may interpret as a force applied by the user, it is necessary to provide means for compensating for such weight, that is, to provide a zero load. Specifically, a non-extensible rope 62 has one end connected to the opposite end of slide 36. From there, rope 62 extends upwardly over a guide pulley 64 freely rotatably mounted at the opposite side of upper cap 32 and then downwardly through vertical support post 30*b*, as shown best in FIG. 5. A counterweight 66 positioned in vertical support post 30*b* is connected to the opposite free end of rope 62. Counterweight 66 is chosen so that, when output shaft 14 is not connected to pulley 48, slide 36 will assume a predetermined neutral position, substantially as shown in FIG. 1. Accordingly, the weight of slide 36 and fixture 42 will not come into play during operation of muscle exercise and/or rehabilitation apparatus 10.

Fixture 42 shown in FIGS. 1–5 is designed to be used in a dynamic mode of muscle exercise and/or rehabilitation apparatus 10. Specifically, with fixture 42, the user moves fixture 42 and slide 36 along guide rods 34. This can be accomplished with dynamometer 12 in an isokinetic or isotonic mode of operation. As such, muscle exercise and/or rehabilitation apparatus 10 can be used as a diagnostic tool to determine, for example, the lifting capability of the user. In such case, as discussed in U.S. Pat. No. 4,691,694, various other components which are shown in said U.S. Patent, can be utilized for analyzing data. For example, a computer, such as an IBM PC, having a keyboard and monitor can be used for analyzing data, along with a printer for producing a hard copy of such data. As disclosed in U.S. Pat. Nos. 4,628,910 and 4,691,694, the dynamometers therein have output terminals for measuring the force applied by the user and the speed of movement of output shaft 14, and thereby of slide 36.

Figure 6:
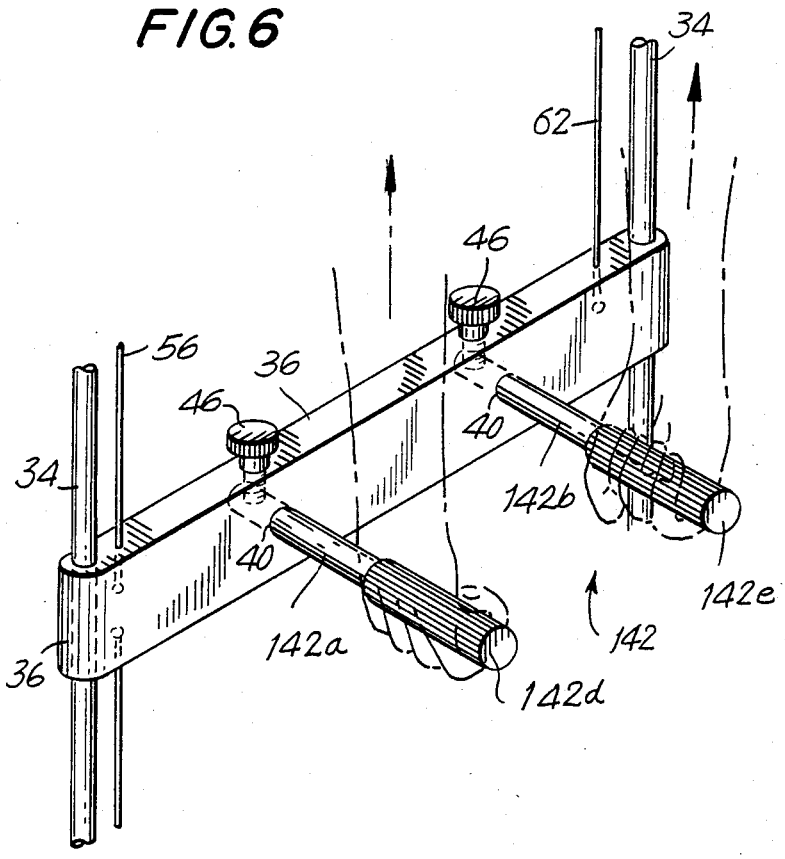
FIG. 6 is a perspective view of the muscle exercise and/or rehabilitation apparatus of FIG. 1, with a different fixture thereon.
Figure 7:
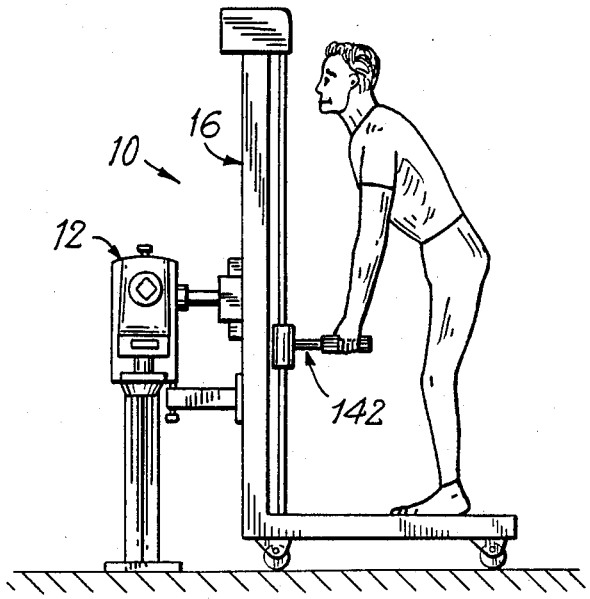
FIG. 7 is a side elevational view of the muscle exercise and/or rehabilitation apparatus of FIG. 1, with the fixture of FIG. 6 in use.

Muscle exercise and/or rehabilitation apparatus 10 can also be used in an isometric mode, in a manner described in U.S. Pat. No. 4,691,694. In such case, it is desirable to use different fixtures. Thus, referring to FIGS. 6 and 7, when slide 36 is to be used at a lower position, a different fixture 142 is provided, which includes two parallel, spaced rod-like arms 142*a* and 142*b*, each of which is inserted through a respective aperture 40 in slide 36 and removably held therein by securing bolts 46. Rubber-like hand grips 142*d* and 142*e* are positioned over the free ends of rod-like arms 142*a* and 142*b* for gripping by the user during operation of muscle exercise and/or rehabilitation apparatus 10 in the isometric mode of operation.

Figure 8:
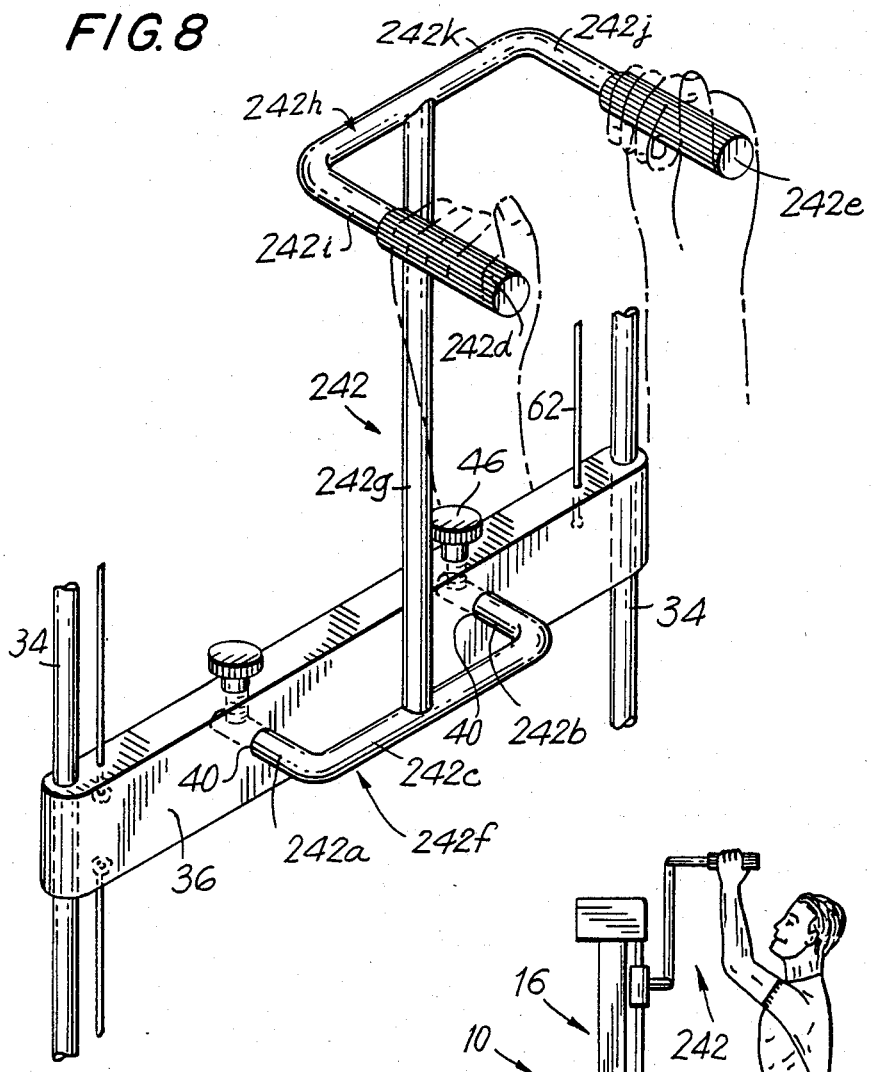
FIG. 8 is a perspective view of the muscle exercise and/or rehabilitation apparatus of FIG. 1, with a different fixture thereon.
Figure 9:
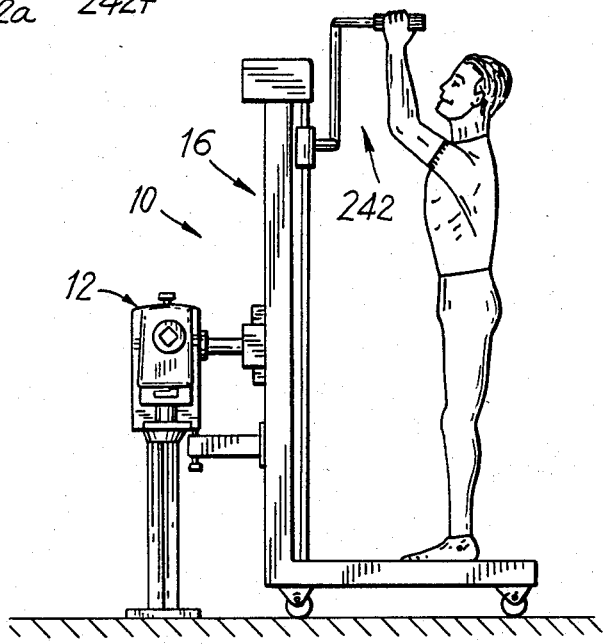
FIG. 9 is a side elevational view of the muscle exercise and/or rehabilitation apparatus of FIG. 1, with the fixture of FIG. 8 in use.

When muscle exercise and/or rehabilitation apparatus 10 is to be used in an overhead isometric mode of operation with slide 36 at an upper position, a different fixture 242 is provided, as shown in FIGS. 8 and 9. Specifically, fixture 242 includes a U-shaped bar 242*f* having two parallel, spaced rod-like arms 242*a* and 242*b*, each of which is inserted through a respective aperture 40 in slide 36 and removably held therein by securing bolts 46. U-shaped bar 242*f* also includes a connecting arm 242*c* which connects the opposite ends of arms 242*a* and 242*b*. A rod-like vertical support arm 242*g* extends upwardly from the middle of connecting arm 242*c*, and another U-shaped bar 242*h* is connected thereto, facing in the opposite direction from U-shaped rod 242*f*. U-shaped bar 242*h* includes two parallel, spaced rod-like arms 242*i* and 242*j*, and a connecting arm 242*k* which connects the free ends of arms 242*i* and 242*j* together. The upper end of vertical support arm 242*g* is connected to the middle of connecting arm 242*k*. Rubber-like hand grips 242*d* and 242*e* are positioned over the free ends of rod-like arms 242i and 242j for gripping by the user during operation of muscle exercise and/or rehabilitation apparatus 10 in the overhead isometric mode of operation.

Thus, with the present invention, muscle exercise and/or rehabilitation apparatus 10 provides a conversion between a controlled rotational motion of output shaft 14 to a linear translational motion of slide 36 which is controlled by the user. As such, the present invention provides an excellent diagnostic tool, as discussed above.

Thus, muscle exercise and/or rehabilitation apparatus 10 as a force sensing lift simulation device is appropriate for clinical applications involving evaluation of whole-body lifting performance, functional lift training and performance rehabilitation, correlation of functional capacity with dynamic isolated muscle testing results, and force distribution analysis and center of gravity tracking during functional lift and lowering activities. These objectives are used to quantitatively identify the capacity for safe and effective load handling. In addition, guidelines for clinical measurement in treatment and injury prevention programs can be developed on the basis of such lift simulation.

Specifically, with muscle exercise and/or rehabilitation apparatus 10, as aforementioned, evaluation of whole-body lifting performance can be made. Thus, static lift strength can be determined through isometric testing at various present heights from 0–80 inches as the simulator range. Dynamic functional lift and lowering capacity can be determined isotonically and isokinetically. Further, preset loads and/or velocity limits can be utilized in testing and exercise, and the range of motion can be limited in any testing or exercise condition, during such simulation. Still further, computerized data acquisition and storage allows for objective analysis and memory recall of force, work, power, and time-dependent phenomena (such as fatigue rate) through curve analysis programs. In addition, function velocities can be accurately controlled and electronic deceleration easily adjusted.

It has been determined that a lift velocity increase of 30% is normally accompanied by a decrease in lifting capacity of up to 50%. Velocity controlled testing may therefore have significant clinical diagnostic impact for functional capacity specifications. In this regard, muscle exercise and/or rehabilitation apparatus 10 provides important opportunities for ergometric assessment in industrial applications. Thus, force analysis and passive guidance of action at predetermined velocities will contribute to the evaluative and rehabilitative protocol repertoire of the clinician.

As described above, muscle exercise and/or rehabilitation apparatus 10 is also important for functional lift training and performance rehabilitation. Thus, aspects of lift performance can be emphasized in training and rehabilitation programs through the specification of parameters. For example, strength training at low functional velocities allows for maximal force/tension development by the neuromusculoskeletal apparatus. Isokinetic measurement insures accommodating load and safe maximal force development. Eccentric task selection allows for engagement of the passive and reflexic load compensation mechanisms of the neuromuscular reflex arc. Moderate to high velocity isokinetic testing can be used to ascertain endurance of the involved musculature with submaximal loads imposed. The use of various fixtures 42, 142 and 242 permit determinations of the effect of load carriage variables on performance. There is the possibility of reaction time training under rigorously controlled conditions so that enhanced performance can be closely monitored.

As to the correlation of functional capacity with dynamic isolated muscle function, use of the same dynamometer 12, adapted either for lumbar muscular testing or lift simulation allows convenient correlation of muscle strength and total tension development with function lift or lower capacity. The advantages of isolated muscle testing in the early stage of rehabilitation include safety, protected movement, torso stabilization and limitation of activity in the non-pathological range of function. Kinetic analysis of exercise provides an estimation of recovery time course functional retraining via muscle exercise and/or rehabilitation apparatus 10.

In regard to force distribution analysis and center of gravity tracking during functional lift and lowering activities, muscle exercise and/or rehabilitation apparatus 10 provides computerized force plate analysis of force distribution and center of gravity shifts to provide a simple method for studying the kinetic adaptations to imposed loads during lifting and lowering activities. Isometric, isotonic and isokinetic testing can be utilized to provide vectorial information with regard to sagittal and frontal plane reactions, and torso rotation moments during lifting.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A muscle exercise and rehabilitation apparatus comprising:

fixture means against which a force can be applied;

sensing means for sensing the force applied to the fixture means and for producing a load signal corresponding thereto;

speed detecting means for producing a velocity signal corresponding to the speed of the fixture means;

servo motor means for producing a rotational output of an output shaft thereof;

closed loop servo means for controlling said motor means in response to said load signal and said velocity signal to control rotation of said output shaft of said servo motor means; and conversion means for driving said fixture means with a linear motion in opposite directions in response to rotation of said output shaft, said conversion means being connected between said fixture means and said output shaft of said servo motor means for translating said rotational output of said output shaft to linear motion of said fixture means.

2. A muscle exercise and rehabilitation apparatus according to claim 1, wherein said conversion means includes:

slide means for supporting said fixture means;

guide means for supporting said fixture means in said linear motion;

operational pulley means rotatably connected with said output shaft of said servo motor means;

rope means secured to said slide means and wrapped about said operational pulley means for controlling movement of said slide means in said linear motion in response to said output shaft of said servo motor means; and rope guide means for guiding said rope means between said slide means and said operational pulley means 3. A muscle exercise and rehabilitation apparatus according to claim 2; wherein said guide means includes two spaced vertical guide rods which slidably support said slide means thereon.

4. A muscle exercise and rehabilitation apparatus according to claim 2; wherein said conversion means further includes frame means for supporting said guide means and said operational pulley means, said frame means including:

base means for supporting a user;

vertical support means extending upwardly from said base means for supporting said guide means and said operational pulley means;

and upper cap means for securing upper ends of said vertical support means together.

5. A muscle exercise and rehabilitation apparatus according to claim 4; wherein said vertical support means includes two vertical support bars extending upwardly from said base means in substantially parallel, spaced relation; and said frame means includes housing means connected between said vertical support bars for supporting said operational pulley means.

6. A muscle exercise and rehabilitation apparatus according to claim 5; further including bearing means connected with said housing means for freely rotatably supporting said operational pulley means and for connecting said pulley means to said output shaft of said servo motor means.

7. A muscle exercise and rehabilitation apparatus according to claim 4; wherein said base means includes markings thereon for accurately positioning said user thereon.

8. A muscle exercise and rehabilitation apparatus according to claim 4; wherein said rope guide means includes an upper guide pulley and a lower guide pulley, and said rope means extends from said operational pulley means, around said upper guide pulley, connected through said slide means, around said lower guide pulley and back to said operational pulley means.

9. A muscle exercise and rehabilitation apparatus according to claim 2; wherein said conversion means further including zeroing means compensating for the weight of said slide means and said fixture means.

10. A muscle exercise and rehabilitation apparatus according to claim 9; wherein said zeroing means includes means for applying an upward force on said slide means corresponding to said weight of said slide means and said fixture means.

11. A muscle exercise and rehabilitation apparatus according to claim 10; wherein said means for applying an upward force includes upper guide pulley means supported by a frame means at a position above said slide means, a counterweight, and second rope means guided about said upper guide pulley means for connecting said counterweight to said slide means, said second rope means and a second first end connected with said counterweight.

12. A muscle exercise and rehabilitation apparatus according to claim 2; wherein said slide means includes at least one first aperture in a front wall thereof and at least one second aperture in a second wall thereof which is at an angle to said front wall such that said at least one second aperture is in communication with said at least one first aperture; said fixture means includes at least one rod-like arm which fits into said at least one aperture in said front wall; and said slide means further includes at least one securing element which fits into said at least one second aperture for securing said at least one-like arm in said at least one first aperture.

13. A muscle exercise and rehabilitation apparatus according to claim 12; wherein said slide means includes two first apertures in the front wall thereof and two second apertures in the second wall thereof, such that each second aperture is in communication with a respective first aperture, and said fixture means includes two spaced, substantially parallel rod-like arms which fit into said two first apertures in said front wall; and said slide means further includes two securing bolts which screw-threadedly fit into said two second apertures for securing said two rod-like arms in said two first apertures.

14. A muscle exercise and rehabilitation apparatus according to claim 13; wherein said two rod-like arms each include a free end and said fixture means further includes a transverse arm connecting said free ends of said two rod-like arms.

15. A conversion device connected between a fixture against which a force can be applied and the output shaft of a muscle exercise and rehabilitation apparatus of the type including sensing means for sensing the force applied to the fixture and for producing a load signal corresponding thereto, speed detecting means for producing a velocity signal corresponding to the speed of the fixture means, servo motor means for producing a rotational output of an output shaft thereof, and closed loop servo means for controlling said motor means in response to said load signal and said velocity signal to control rotation of said output shaft of said servo motor means, so as to translate said rotational output of said output shaft to linear motion of said fixture, said conversion device comprising:

slide means for supporting said fixture means;

guide means for supporting said fixture means in said linear motion;

operational pulley means for driving said slide means with a linear motion in opposite directions in response to rotation of said output shaft, said operational pulley means being rotatably connected with said output shaft of said servo motor means;

rope means secured to said slide means and wrapped about said operational pulley means for controlling movement of said slide means in said linear motion in response to said output shaft of said servo motor means; and rope guide means for guiding said rope means between said slide means and said operational pulley means.

16. A conversion device according to claim 15; wherein said guide means includes two spaced vertical guide rods which slidably support said slide means thereon.

17. A conversion device according to claim 15; wherein further includes frame means for supporting said guide means and said operational pulley means, said frame means including:

base means for supporting a user;

vertical support means extending upwardly from said base means for supporting said guide means and said operational pulley means;

and upper cap means for securing upper ends of said vertical support means together.

18. A conversion device according to claim 17; wherein said vertical support means includes two vertical support bars extending upwardly from said base means in substantially parallel, spaced relation; and said frame means further includes housing means connected between said vertical support bars for supporting said operational pulley means.

19. A conversion device according to claim 18; further including bearing means connected with said housing means for freely rotatably supporting said operational pulley means and for connecting said operational pulley means to said output shaft of said servo motor means.

20. A conversion device according to claim 17; wherein said base means includes markings thereon for accurately positioning said user thereon.

21. A conversion device according to claim 17; wherein said rope guide means includes an upper guide pulley and a lower guide pulley, and said rope means extends from said operational pulley means, around said upper guide pulley, is connected through said slide means, around said lower guide pulley and back to said operational pulley means.

22. A conversion device according to claim 15; wherein further includes zeroing means for compensating for the weight of said slide means and said fixture means.

23. A conversion device according to claim 22; wherein said zeroing means includes means for applying an upward force on said slide means corresponding to said weight of said slide means and said fixture means.

24. A conversion device according to claim 23; wherein said means for applying an upward force includes upper guide pulley means supported by a frame means at a position above said slide means, a counterweight, and second rope means guided about said upper guide pulley means for connecting said counterweight to said slide means, said second rope means including a first end connected with said slide means and a second opposite end connected with said counterweight.

* * * * *